US006678986B2

(12) United States Patent
Roush

(10) Patent No.: US 6,678,986 B2
(45) Date of Patent: Jan. 20, 2004

(54) HANDGUN AIMING DEVICE AND METHOD

(75) Inventor: Ronald Roush, Peoria, AZ (US)

(73) Assignee: L & R Engineering, Inc., Westminister, CO (US)

( * ) Notice: Subject to any disclaimer, the term of this patent is extended or adjusted under 35 U.S.C. 154(b) by 53 days.

(21) Appl. No.: 10/044,673

(22) Filed: Nov. 9, 2001

(65) Prior Publication Data

US 2003/0089017 A1 May 15, 2003

(51) Int. Cl.[7] ..... F41A 27/00
(52) U.S. Cl. ..... 42/94; 2/161.5; 2/159
(58) Field of Search ..... 42/94, 72, 21.01; 248/113; 2/161.5, 159

(56) References Cited

U.S. PATENT DOCUMENTS

| | | | | | |
|---|---|---|---|---|---|
| 1,027,556 | A | | 5/1912 | Marshall | |
| 1,177,748 | A | | 4/1916 | Webster | |
| 2,423,448 | A | * | 7/1947 | Haight | 42/13 |
| 2,985,980 | A | | 5/1961 | Broshous | 42/94 |
| 3,162,966 | A | | 12/1964 | Coss | 42/72 |
| 3,184,877 | A | | 5/1965 | Andrews | 42/72 |
| 3,553,878 | A | | 1/1971 | Canon | 42/94 |
| 3,609,902 | A | | 10/1971 | Casull | 42/72 |
| 3,648,396 | A | | 3/1972 | Smith | 42/94 |
| 3,740,886 | A | | 6/1973 | Canon | 42/94 |
| 3,881,197 | A | * | 5/1975 | Andrews | 2/161 |
| 3,927,808 | A | | 12/1975 | Steen | 224/1 |
| 4,006,548 | A | | 2/1977 | Vignini | 42/1 |
| 4,271,623 | A | | 6/1981 | Beretta | 42/72 |
| 4,291,482 | A | | 9/1981 | Bresan | 42/72 |
| 4,321,765 | A | | 3/1982 | Gillum | 42/72 |
| 4,441,711 | A | * | 4/1984 | Dubar et al. | 473/61 |
| 4,458,659 | A | * | 7/1984 | Troncoso, Jr. | 124/35.2 |
| 4,515,301 | A | | 5/1985 | A'Costa | 224/204 |
| 4,608,720 | A | * | 9/1986 | Purin | 2/161.1 |
| 4,843,749 | A | * | 7/1989 | Griffith | 42/72 |
| 4,982,522 | A | | 1/1991 | Norton | 42/85 |
| 5,056,253 | A | | 10/1991 | Willumsen | 42/94 |
| 5,180,874 | A | | 1/1993 | Troncoso, Jr. | 42/72 |
| 5,214,798 | A | | 6/1993 | McLaughlin | 2/160 |
| 5,361,525 | A | | 11/1994 | Bowes | 42/70.11 |
| 5,449,103 | A | * | 9/1995 | Tilley | 224/244 |
| 5,761,842 | A | | 6/1998 | Mantymaa | 42/71.02 |
| 5,864,884 | A | * | 2/1999 | Salvitti | 2/159 |
| 6,016,620 | A | | 1/2000 | Morgan | 42/94 |
| 6,029,321 | A | | 2/2000 | Fisher | 24/306 |
| 6,101,628 | A | * | 8/2000 | Earl | 2/21 |
| 6,112,448 | A | | 9/2000 | Gray et al. | 42/94 |
| 6,195,927 | B1 | | 3/2001 | Fortenberry | 42/90 |
| 6,216,351 | B1 | | 4/2001 | Flubacher et al. | 33/241 |
| 6,216,352 | B1 | | 4/2001 | Lorocco | 33/241 |
| 6,270,231 | B1 | * | 8/2001 | Kerr | 362/110 |
| 6,305,115 | B1 | * | 10/2001 | Cook | 42/74 |

* cited by examiner

*Primary Examiner*—Michael J. Carone
*Assistant Examiner*—Denise J Buckley
(74) *Attorney, Agent, or Firm*—Snell & Wilmer LLP

(57) ABSTRACT

A handgun aiming comprises a wrist and hand stabilizer configured for substantially fixing an orientation of a wrist of a user relative to a hand of the user. The device also comprises a fastener configured for fastening the stabilizer to both the wrist and the hand of the user. The fastener may also be configured for fastening the stabilizer to a finger, a palm, a wrist, and/or a gun. In addition, the device may comprise a light means for illuminating a target and/or shock mitigating means such as gel, neoprene, or a fibrous filler. Accordingly, the device improves consistency and stability when aiming and firing a handgun without compromising the speed at which the user may receive and release the handgun and without encumbering the movement of the user's arm. The device and method may also be effective in reducing the occurrence of injuries to a handgun user.

26 Claims, 6 Drawing Sheets

HANDGUN AIMING DEVICE AND METHOD

FIELD OF THE INVENTION

The present invention relates to handgun aiming devices. More particularly, the present invention relates to a device for stabilizing the wrist and hand of a handgun user for consistently positioning the user's hand and thereby improving the manner in which the user may receive, grip and aim a handgun.

BACKGROUND OF THE INVENTION

In today's world, handguns serve a variety of purposes including personal protection, law enforcement, hunting, and recreation. In serving these needs, however, a variety of difficulties often arise in the handling and firing of handguns which may be attributed to handgun weight, recoil caused by handgun firing, and instabilities and inconsistencies in the handgun shooter's positioning, aiming, and maintaining the handgun's position. A variety of attempts have been made to address these problems through handgun design. These attempts, however, have consistently caused tradeoffs to be made between handgun size, weight, recoil, and handling capability.

Other attempts have been made to address these problems through auxiliary devices. For example, sighting aids such as scopes and light emitting pointers are readily available for affixing to the barrel of a handgun to aid in its aiming. For example, U.S. Pat. No. 6,216,352, granted to Lorocco on Apr. 17, 2001, discloses a weapon sight device adapted for use directly on or affixed to the barrel of a rifle, handgun or other weapon. Similarly, U.S. Pat. No. 6,216,351, granted to Flubacher on Apr. 17, 2001, discloses a weapon sight device having a mounting base to be affixed to the barrel of a gun. These devices, however, tend to add to the weight of the weapon and present additional difficulties in holstering and handling the weapons on which they may be mounted. These devices must also be designed to survive the shock associated with the firing of the handgun, those shocks being effectively transferred to the device when they are fixedly attached to the handgun.

In addition, a variety of braces are available for affixing directly to handguns to aid in their steadying in both aiming and shooting. For example, stabilizing devices have been developed for attachment to a handgun and often rely upon a tension strap or a rigid member for stabilizing the handgun with respect to the arm shoulder or torso of the shooter. For example, U.S. Pat. No. 6,016,620, granted to Morgan in 2000, discloses an arm and handgun support apparatus configured to adjustably attach to the barrel of a gun as well as to the user's forearm. Similarly, U.S. Pat. No. 5,761,842, granted to Mantymaa in 1998, discloses a wrist support device to be affixed to a handgun providing a bracing support for steadying the handgun in the user's hand. In addition, U.S. Pat. No. 4,321,765, granted to Gillum in 1982, discloses a steadying device to be affixed to a handgun to provide a second handle for the user to grip for steadying the handgun. In each of these examples, however, the disclosed devices require attachment of a substantially rigid member directly to the gun in order to produce the desired stability. As a result, the devices are cumbersome to use and do not permit very fast access to their benefits.

Other attempts to provide stability by attaching directly to the gun include the use of tension straps rather that substantially rigid members. For example, U.S. Pat. No. 6,112,448, granted to Gray in 2000, discloses a stabilizing strap that connects, at one end, to the barrel of a gun and, at the other end, to a brace that is attached to the user's forearm. Similarly, U.S. Pat. No. 4,515,301, granted to A'Costa in 1985, discloses a harness/strap device for encompassing the user's body and attaching to the butt of a handgun. Further, U.S. Pat. No. 2,985,980, granted to Broshous in 1959, discloses a strap connected to a gun and around the neck of the user, whereby the user straightens his/her arm to apply tension to the strap and thereby stabilize the handgun. In each of these examples, however, the user must attach the tension strap to the gun before the device can enhance the stability of the gun. Thus, similar to the rigid member devices disclosed above, these tension strap devices are cumbersome to use and do not permit very fast access to their benefits.

Other attempts to improve the stability of the gun, though not requiring attachment directly to the gun, do not enable the gun to be freely placed into the hand or removed from the hand. For example, U.S. Pat. No. 6,195,927, granted to Fortenberry on Mar. 6, 2001, discloses a firearm gripping device that wraps around the user's hand while the user is gripping a handgun. Unfortunately, this device does not permit a handgun to be placed in, or removed from, the user's hand without removing the device from the user's hand, preventing the user from freely placing a handgun in his/her hand or removing a handgun from his/her hand without removing the device. Similar to the devices disclosed above, such gripping devices are cumbersome to use and do not permit very fast or convenient access to, or relief from, their benefits.

Other attempts to improve the stability of a gun, while not requiring attachment directly to the gun, have focused on reinforcing the user's arm. For example, U.S. Pat. No. 5,180,874, granted to Troncoso in 1991, discloses a handgun brace that rests against, but does not connect to the handgun, providing a rigid support relative to the user's forearm. Similarly, U.S. Pat. No. 3,740,886, granted to Canon in 1973, discloses a strap that affixes a rigid member to the user's wrist for bracing against the user's shoulder for stabilizing the user's hand relative to the user's body. Further, U.S. Pat. No. 3,553,878, granted to Canon in 1968, discloses a brace that may be positioned between the user's hand and the user's armpit for stabilizing the user's hand relative to the user's body. Finally, U.S. Pat. No. 5,056,253, granted to Willumsen in 1991, discloses strap that encompasses the user's neck and attaches to the user's thumb for stabilizing the user's hand with respect to the user's body. These devices, unfortunately, do not permit free movement of the user's arm while they are installed. They also require the use of both of the user's hands. As a result, similar to the devices disclosed above, such arm stabilizing devices are cumbersome to use and do not permit very fast or convenient access to their benefits without compromising the normal functioning of the user's arm.

In each of these cases the devices are awkward to install and remove from use with the handgun. Devices requiring attachment to a handgun must either be removed from the handgun prior to holstering or storage or will make such handling more difficult. Devices that may not require attachment directly to a handgun typically have restricted the movement of the user or restrict the ability of the user to alternatively grip and release a handgun. Further, these devices increase the difficulty of handling and storing the handguns and the devices. They are simply difficult to carry, which tends to defeat the benefits associated with handgun usage.

Moreover, none of the above described attempts to improve the user's ability to consistently and accurately aim and shoot a firearm address the injuries commonly encountered by firearm users. These injuries often occur as a result of fatigue caused by prolonged holding, carrying, and firing of firearms.

Accordingly, it would be advantageous to have a handgun shooting brace that prevents injury, promotes safety and improves shooting accuracy. In an exemplary embodiment, the device may be configured as a glove. In another exemplary embodiment, the device may incorporate a light beam emitter to aid in aiming a handgun without requiring the light beam emitter to be affixed to the handgun.

SUMMARY OF THE INVENTION

The method and device of the present invention address many of the shortcomings of the prior art. In accordance with various aspects of the present invention, an improved device and method are provided which enable the user to consistently and steadily aim and shoot a handgun without compromising the speed at which the user may receive and release the handgun and without encumbering the movement of the user's arm. The device and method can also reduce injuries to the handgun user by reducing the impact of the handgun on the hand of the user when the handgun is fired. In accordance with an exemplary embodiment of the present invention, a wrist and hand stabilizer is provided comprising a wrist and hand stabilizer and fastening means. In accordance with an exemplary embodiment, shock mitigating means are provided. In accordance with another exemplary embodiment, sighting means are provided.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS

Figure 1A:
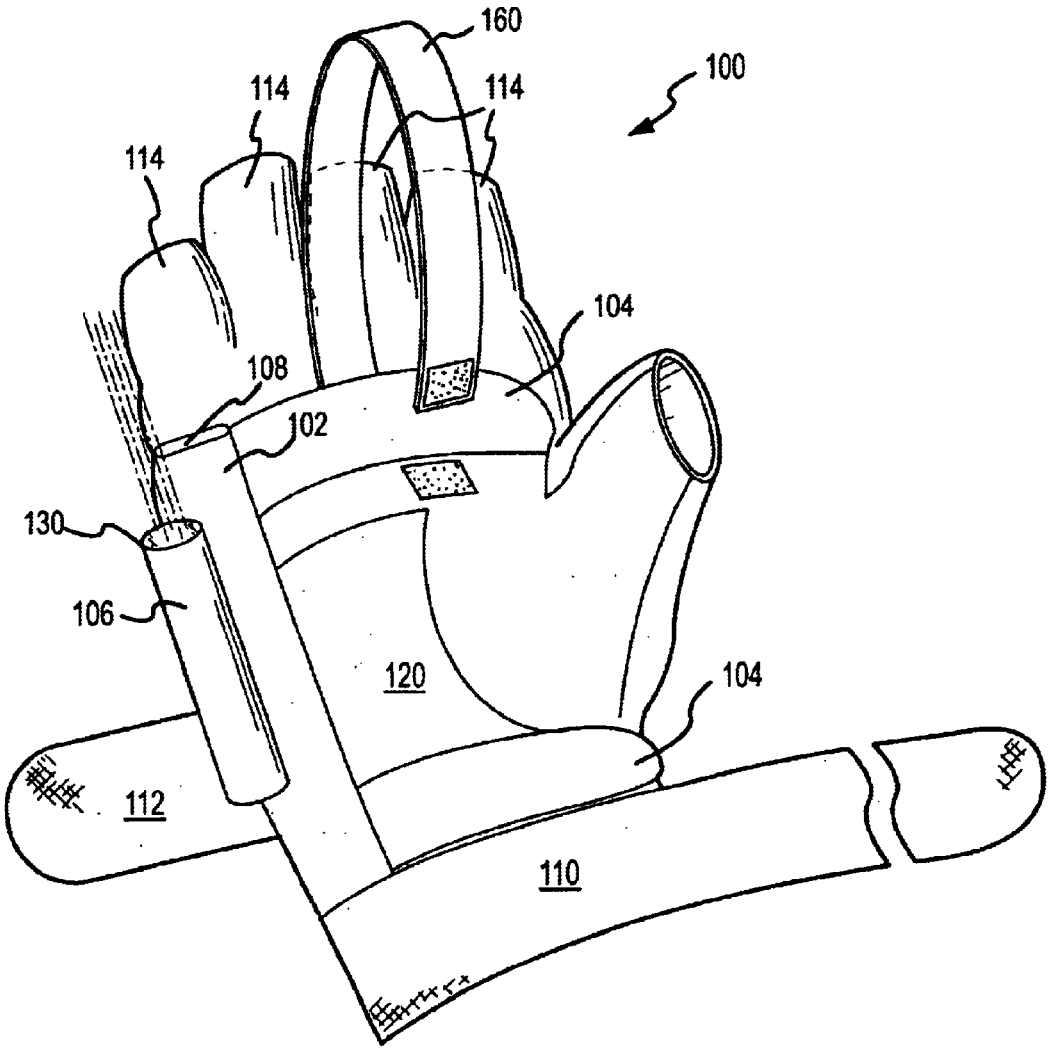
FIGS. 1*a–e* illustrates exemplary handgun aiming devices in accordance with various exemplary embodiments of the present invention.
Figure 1B:
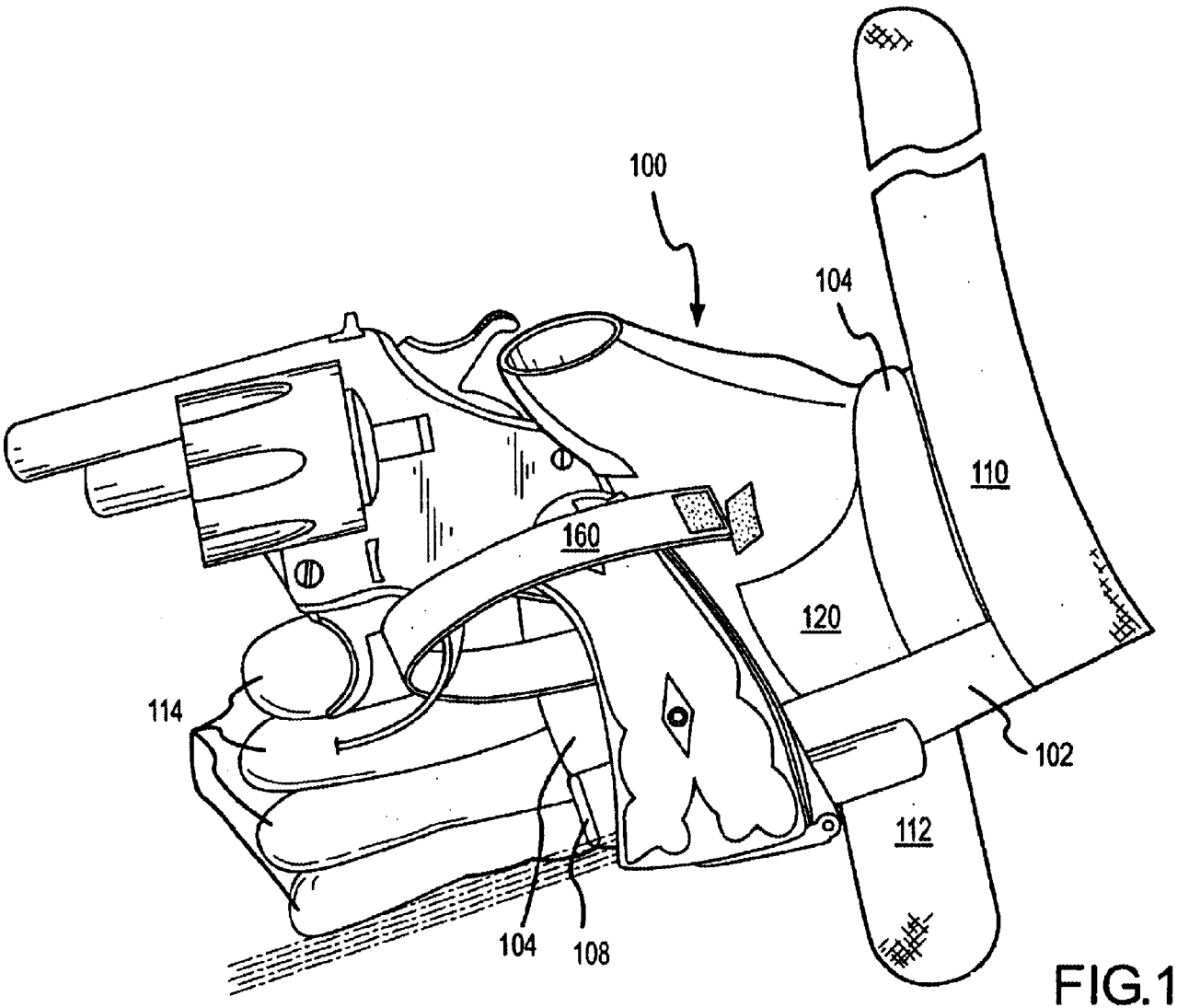
Figure 1C:
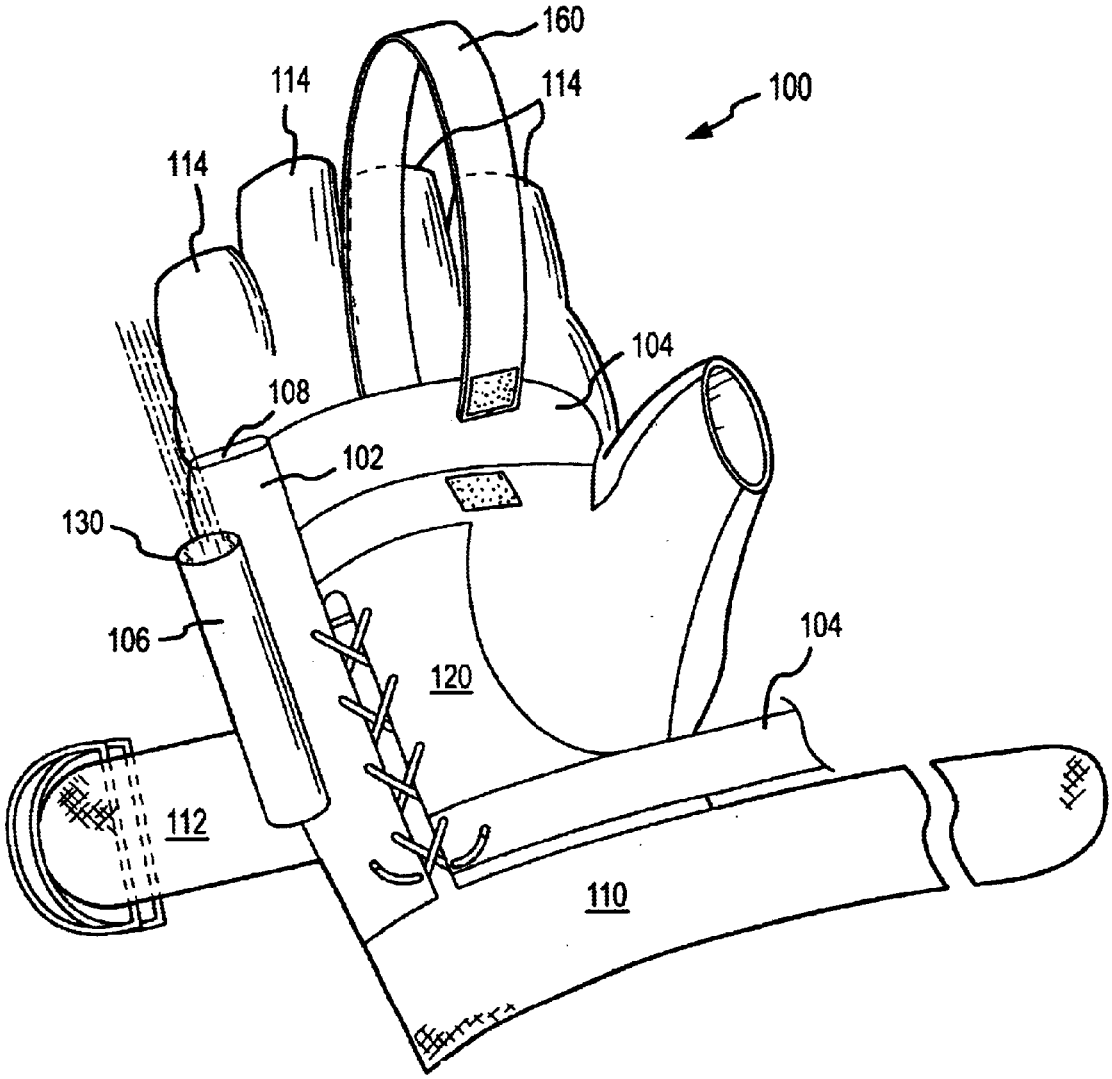
Figure 1D:
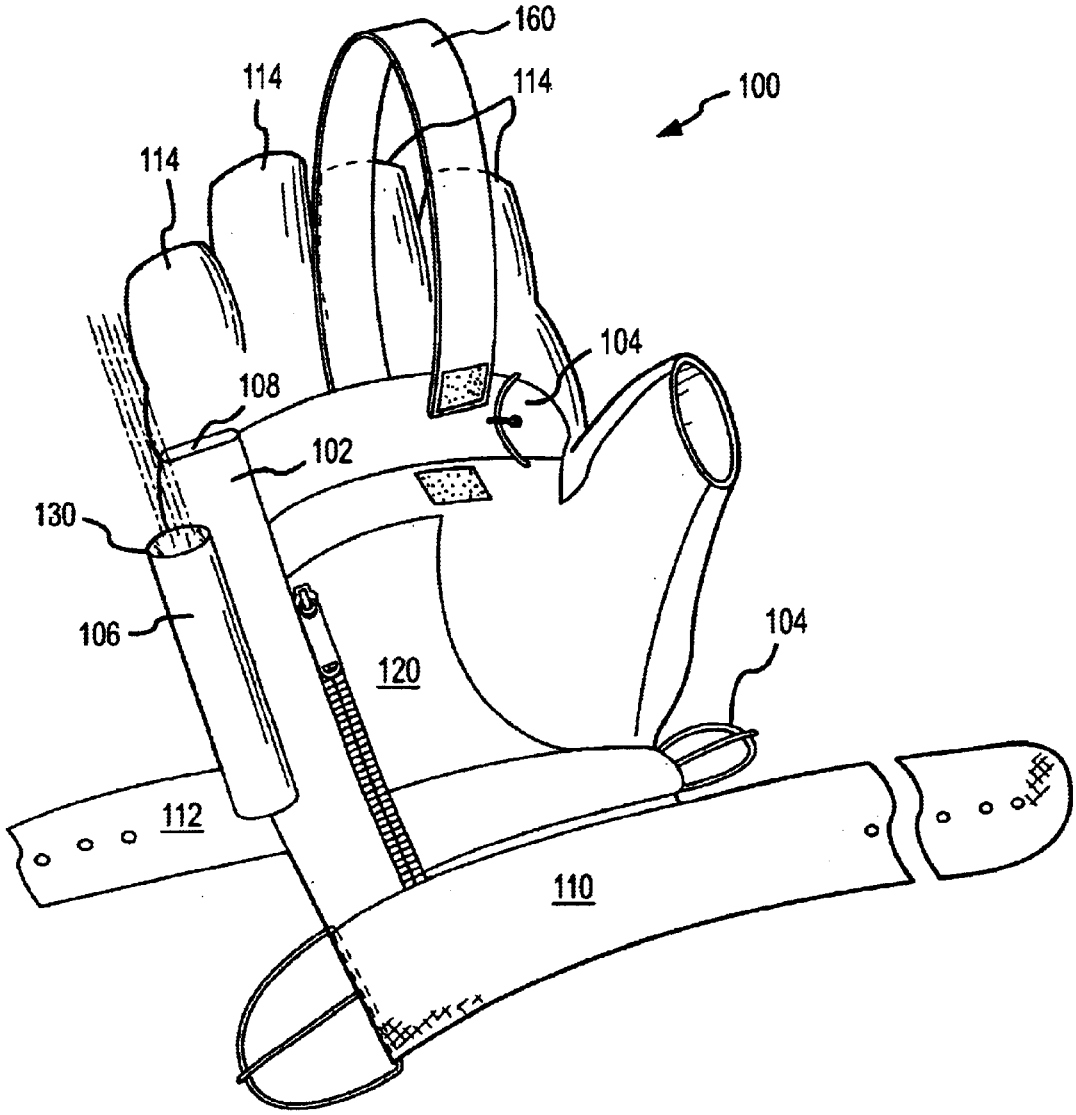
Figure 1E:
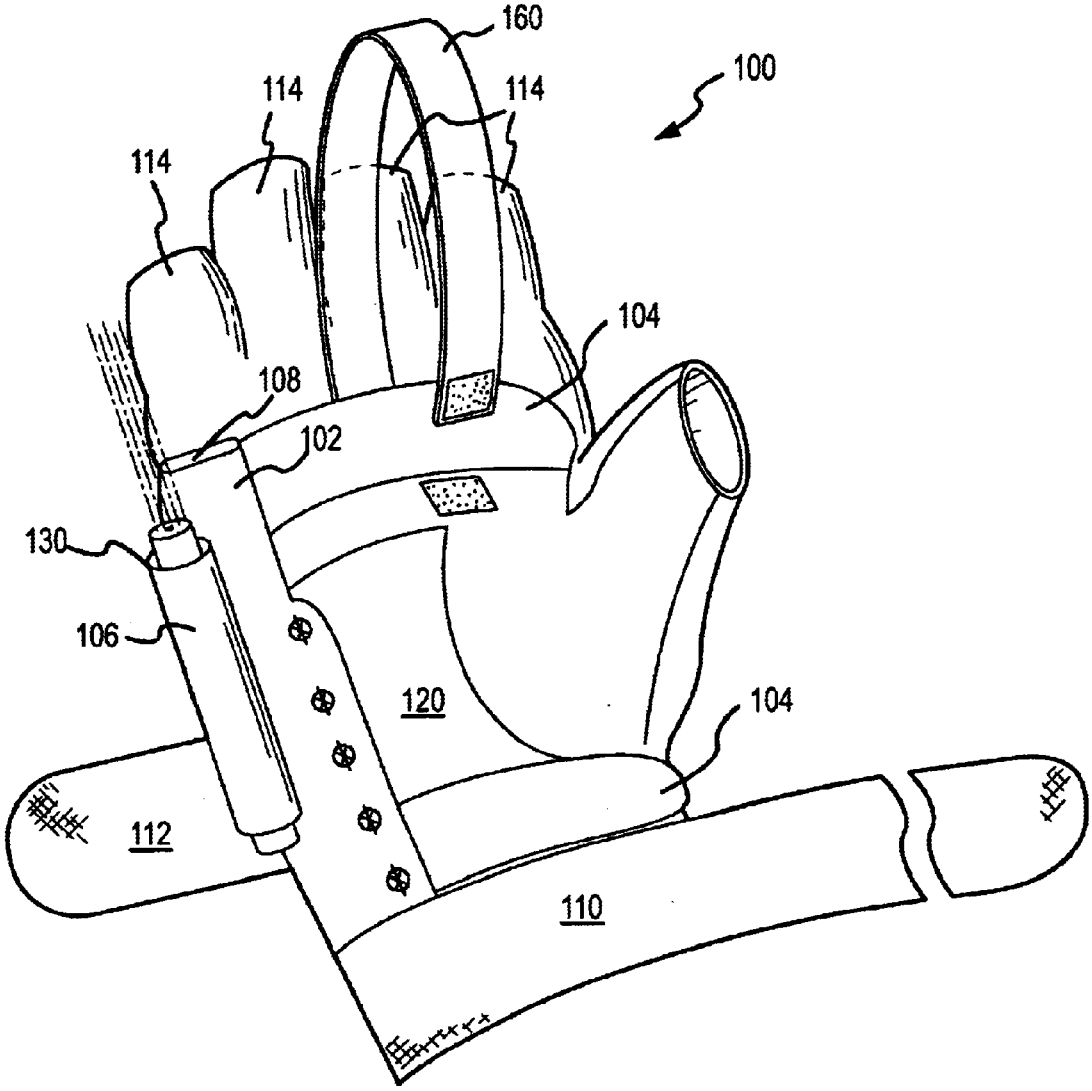

The present invention may be described herein in terms of various functional components and various process steps. It should be appreciated that such functional components may be realized by any number of structural components configured to perform the specified functions. For example, the present invention may employ various materials such as leather, rubber, neoprene, canvas, plastic, fabrics made of natural and/or synthetic fibers, plastic, graphite composite materials and the like whose material properties may be suitably configured for various intended purposes. In addition, the present invention may be practiced in a variety of general applications which may be appreciated by those skilled in the art in light of the present disclosure but which are not disclosed in detail herein. However for purposes of illustration only, exemplary embodiments of the present invention will be described herein in connection with handgun aiming devices.

As discussed above, prior art attempts at improving the handling and firing of handguns have focused on limiting the movement of the handgun with respect to the arm and/or body of the user. These prior art attempts therefore limit the ability of the user to freely move his or her arm and limit the user's ability to alternately grip and release a handgun while enhancing the consistency and speed with which the handgun may be aimed and fired. Accordingly, the device and method enables the user to consistently and steadily aim and shoot a handgun while minimizing the difficulties presented in the prior art.

In accordance with various aspects of the present invention, however, an improved device and method are provided to improve the handling and aiming of handguns without adversely impacting the mobility or comfort of the handgun user or the weight, size, or handling characteristics of the user's handgun. In accordance with an exemplary embodiment, a device is provided that stabilizes the user's wrist and hand in a position that consistently conforms to a handgun, yet permits the handgun to be freely removed from or placed into the user's hand without removing or replacing the reinforcement mechanism.

With reference to FIGS. 1*a–e*, in accordance with various exemplary embodiments of the invention, the device 100 comprises a wrist/hand-stabilizer 102 and fastening means 104. The fastening means 104 is adapted to receive the wrist and hand stabilizer 102 and to fasten the stabilizer 102 to the user's wrist and hand. When fastened to the wrist and hand of the user, the device consistently positions the user's hand for receiving a handgun and substantially fixes the orientation of the wrist of the user relative to the hand of the user. The consistent positioning of the hand prevents the relative position of the handgun in the hand from changing appreciably and improves the user's grip upon the handgun. As a result, the present invention prevents injuries, promotes safety and improves shooting accuracy. In addition, the device concurrently eliminates the need for direct fastening to the handgun, as well as constraints upon the user's free arm movement, while providing easy removal of the handgun from, and replacement into, the hand. Further, the device may be worn comfortably while the handgun is not being used.

The wrist and hand stabilizer 102 of the present invention may comprise any sufficiently rigid material such as metal, plastic leather, wood and the like. It is preferable that a lightweight material such as aluminum be used to minimize weight. Plastics may also be desirable due to their ability to be molded to fit the user's hand and wrist and handgun to enhance function and comfort of the device. Further, the stabilizer 102 may be adapted to be molded and/or re-molded by the user such as by applying heat to the stabilizer 102 followed by shaping the stabilizer 102 followed by cooling the stabilizer 102. Similarly, the stabilizer 102 may be made of a relatively soft metal such as aluminum so that it may be adjusted by the user. The stabilizer 102 may be configured to extend along the base of the hand from the user's pinkie finger, opposite the user's thumb, to the user's wrist. In this exemplary embodiment, the stabilizer 102 is not positioned between the gun and the user's palm. Alternatively, the stabilizer 102 may be configured to extend from the user's wrist and the base of the user's hand to occupy a position between the user's hand and the gun, thereby creating a saddle to receive the gun and protect the user's hand and stabilize the gun while in the user's hand. In another embodiment, the stabilizer 102 may be configured to extend to the base of the user's thumb.

In accordance with an exemplary embodiment, the fastening means 104 of the present invention is adapted to receive the wrist and hand stabilizer 102 and to fasten it to the wrist and hand of the user. As used herein, the hand of the user includes the fingers and the thumb of the user. In an exemplary embodiment, the stabilizer and the fastening means extend to the user's wrist and sufficiently engages the user's wrist to stabilize the user's wrist with respect to the user's hand, preventing excessive movement of the user's hand relative to the user's forearm. The device may be adapted to prevent all movement, such as lateral, vertical, and rotational movement of the hand relative to the forearm. Alternatively, the device may be configured to permit some movements while preventing or restricting others. In a further embodiment, the device may be configured to extend beyond the user's wrist and up the forearm of the user so long as such extension is adapted to permit the user to retain normal arm function with respect to the user's elbow and shoulder joints.

In an exemplary embodiment, the fastening means 104 may comprise an elongated glove having a pocket or a slot 108 into which the stabilizer 102 may be fixed by such means as sewing or affixing a snap or button or a hook and loop fastener or the like or by replacing a flap. In this embodiment, the fastening means 104 may be configured to enable the stabilizer 102 to be removed to be exchanged and/or modified and replaced. Further, the glove may be configured to cover all of the fingers of the user or only a portion of the fingers such as only three fingers, leaving the index finger uncovered, or covering only a portion of each finger, leaving the fingertips exposed. In addition, the fastening means 104 may comprise one or more finger fasteners 114, one or more palm fasteners 112, one or more wrist fasteners 110, and/or any combination of finger, palm and wrist fasteners. A gun fastener 160 may also be provided to retain the gun against the stabilizer. The gun fastener may also be configured to be releasable when placed in contact, or in proximity with, a holster such that the gun may be holstered without requiring a second hand.

It should be noted that each of the finger, palm, wrist, and gun fasteners may comprise hook and loop fasteners, D-ring fasteners, belts and buckles, straps and clamps, elastic, laces, snaps, zippers, adhesives, buttons, and the like. It should also be noted that the fastening means may be constructed of any suitable material such as leather, rubber, neoprene, canvas, plastic, and the like. The specific material or combination of materials may be chosen to provide additional functionality such as thermal insulation, water resistance, or vapor permeability. It should also be noted that the device may be configured to exhibit colors or patterns of colors and/or textures chosen for aesthetic purposes such as to be appealing to a women, to match a uniform such as that of a police officer or other government personnel, to be low in light emissivity, or to disguise its presence by being adapted to match the skin coloration of the user. The device may also be adapted to display a camouflage pattern. The fastening means may also be adapted to be reversible (e.g., capable of fitting both a right hand or a left hand).

In yet another exemplary embodiment, the device may comprise shock mitigating means to absorb and soften the forces caused by the recoil the handgun may produce when it is fired. The shock mitigating means may include a pad 120 made of gel, rubber, neoprene or the like. The shock mitigating means may also comprise a pad 120 consisting of a fibrous filler of natural fibers such as cotton and the like or synthetic material such as polyester and the like. Further, the shock mitigating means 120 may be formed as an integral part of the fastening means.

In another exemplary embodiment, the device of the present invention may include sighting means 130 adapted to aid in the aiming of the handgun. The sighting means 130 may comprise a light emitting device such as a pen light flashlight, a laser pointer and the like. The light emitting device may be fastened to the wrist and hand stabilizer through a variety of fastening means as described above. Further, the sighting means may be adapted to fit into a pocket 106 of the fastening means described above and the fastening means may be adapted to receive the sighting means 130. As a result, the sighting means 130 does not need to be attached directly to the handgun, which reduces the need for the sighting means to be able to withstand shocks associated with the firing of the gun.

Figure 2:
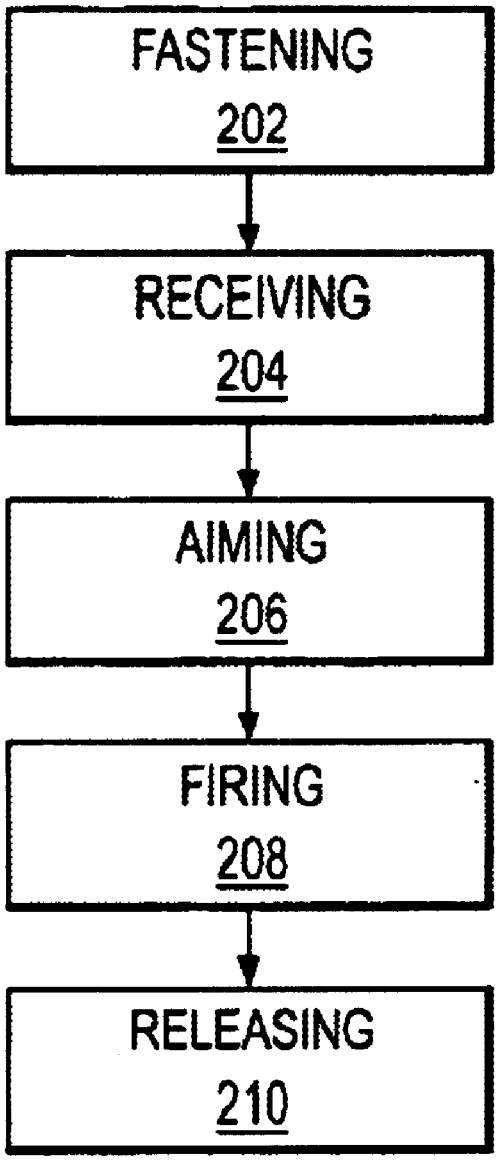
FIG. 2 illustrates an exemplary method in accordance with an exemplary embodiment of the present invention.

With reference to FIG. 2, in accordance with an exemplary embodiment of the present invention, a user may consistently and steadily aim and shoot a handgun without compromising the speed at which the user may receive and release the handgun and without encumbering the movement of the user's arm. The user may enjoy these benefits while reducing their risk of injury by fastening a wrist and hand stabilizer to a wrist and hand of a user (step 202), receiving a handgun into the stabilizer (step 204), aiming the handgun toward a desired target (step 206), firing the handgun at the target (step 208), and releasing the handgun (step 210).

The present invention has been described above with reference to various exemplary embodiments. However, those skilled in the art will recognize that changes and modifications may be made to the exemplary embodiments without departing from the scope of the present invention. These alternatives can be suitably selected depending upon the particular application or in consideration of any number of factors associated with the operation of the device. Moreover, these and other changes or modifications are intended to be included within the scope of the present invention, as expressed in the following claims.

What is claimed is:

1. A handgun aiming device comprising a wrist and hand stabilizer, and fastening means;

wherein said wrist and hand stabilizer comprises a rigid member configured for aiming a hand gun and aiming a handgun and substantially fixing an orientation of a wrist of a user relative to a hand of the user, wherein said wrist and hand stabilizer is configured to extend along a base of said hand, and wherein said fastening means is adapted to receive said wrist and hand stabilizer and to fasten said wrist and hand stabilizer to said aiming gun, said wrist and said hand.

2. The device of claim 1, wherein said fastening means comprises a finger fastener.

3. The device of claim 1, wherein said fastening means comprises a palm fastener.

4. The device of claim 1, wherein said fastening means comprises a wrist fastener.

5. The device of claim 1, wherein said fastening means comprises a gun fastener.

6. The device of claim 1, wherein said fastening means comprises hook and loop fasteners.

7. The device of claim 1, wherein said fastening means is selected from the group consisting of D-rings, buckle, clamp, elastic, laces, snaps, zippers, adhesive, and buttons.

8. The device of claim 1, wherein said fastening means is comprised of a material selected from the group consisting of leather, rubber, neoprene and canvas.

9. The device of claim 1, wherein said fastening means comprises a glove.

10. The device of claim 9, wherein said glove is configured to cover a portion of a finger of the user.

11. The device of claim 9, wherein said glove is configured to cover substantially all of a finger of the user.

12. The device of claim 1, wherein said wrist and hand stabilizer is comprised of metal.

13. The device of claim 12, wherein said wrist and hand stabilizer is comprised of aluminum.

14. The device of claim 1, wherein said wrist and hand stabilizer is comprised of plastic.

15. The device of claim 1, wherein said wrist and hand stabilizer is comprised of leather.

16. The device of claim 1, wherein said wrist and hand stabilizer is comprised of wood.

17. The device of claim 1, wherein said wrist and hand stabilizer is adapted to conform to the user.

18. The device of claim 1, wherein said wrist and hand stabilizer is adapted to be adjusted by the user.

19. The device of claim 1, further comprising sighting means.

20. The device of claim 19, wherein said sighting means comprises a light emitter.

21. The device of claim 20, wherein said light emitter is configured to be focused by the user.

22. The device of claim 1, further comprising shock mitigating means.

23. The device of claim 22, wherein said shock mitigating means is comprised of gel.

24. The device of claim 22, wherein said shock mitigating means is comprised of neoprene.

25. The device of claim 22, wherein said shock mitigating means is comprised of fibrous filler.

26. An improved method for aiming and firing a handgun comprising the steps of:

fastening a wrist and hand stabilizer to a wrist and hand of a user, receiving a handgun into said wrist and hand stabilizer;

aiming said handgun toward a desired target; and firing said handgun at said target;

wherein said wrist and hand stabilizer is configured to extend along a base of said hand, wherein said wrist and hand stabilizer comprising a rigid member configured for substantially fixing an orientation of a wrist of a user relative to a hand of the user.

* * * * *